US009429373B2

(12) United States Patent
Park et al.

(10) Patent No.: US 9,429,373 B2
(45) Date of Patent: Aug. 30, 2016

(54) HEAT EXCHANGER

(75) Inventors: Taegyun Park, Seoul (KR); Naehyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 766 days.

(21) Appl. No.: 13/452,307

(22) Filed: Apr. 20, 2012

(65) Prior Publication Data

US 2012/0267072 A1 Oct. 25, 2012

(30) Foreign Application Priority Data

Apr. 21, 2011 (KR) ..... 10-2011-0037412

(51) Int. Cl.

| | |
|---|---|
| ***F25D 21/00*** | (2006.01) |
| ***F28F 17/00*** | (2006.01) |
| ***F28D 1/053*** | (2006.01) |
| ***F28F 1/32*** | (2006.01) |
| *F28D 21/00* | (2006.01) |

(52) U.S. Cl.

CPC ..... *F28F 17/005* (2013.01); *F28D 1/05316* (2013.01); *F28F 1/32* (2013.01); *F28F 1/325* (2013.01); *F28D 2021/0068* (2013.01); *F28F 2240/00* (2013.01)

(58) Field of Classification Search

CPC ..... F25D 21/14; F24F 13/22

USPC ..... 62/272, 513, 515, 524, 290; 165/173, 165/181, 104.13

See application file for complete search history.

(56) References Cited

U.S. PATENT DOCUMENTS

| | | | | |
|---|---|---|---|---|
| 3,135,320 | A * | 6/1964 | Forgo | 165/151 |
| 3,438,433 | A * | 4/1969 | Gunter | 165/151 |
| 4,434,844 | A * | 3/1984 | Sakitani et al. | 165/151 |
| 5,042,576 | A | 8/1991 | Broadbent | |
| 5,111,876 | A | 5/1992 | Nash | |
| 5,360,060 | A | 11/1994 | Tanaka et al. | |
| 2003/0000686 | A1 | 1/2003 | Kester | |
| 2007/0151716 | A1 | 7/2007 | Lee et al. | |

FOREIGN PATENT DOCUMENTS

| | | | |
|---|---|---|---|
| CN | 2643266 | Y | 9/2004 |
| CN | 101943537 | A | 1/2011 |
| JP | 51040192 | | 3/1976 |
| JP | 57149518 | U | 9/1982 |
| JP | 58156107 | U | 10/1983 |
| JP | 05-005596 | | 1/1993 |
| JP | 5-34470 | U | 5/1993 |
| JP | 09-203593 | | 5/1997 |
| JP | 10141880 | A | 5/1998 |
| JP | 10281674 | A | 10/1998 |
| JP | 2001-317890 | A | 11/2001 |

(Continued)

*Primary Examiner* — Melvin Jones

(74) *Attorney, Agent, or Firm* — Dentons US LLP

(57) ABSTRACT

Provided is a heat exchanger, which includes a plurality of tubes and a plurality of fins. The tubes accommodate respective refrigerant passages through which refrigerant flows. The fins having a plate shape are spaced apart from each other, and include a plurality of through holes through which the tubes pass, respectively. The fin is provided with a condensate water guide part guiding discharge of condensate water generated during heat exchange between air and the refrigerant flowing through the tube. Accordingly, adhesion of the tube and the fin is facilitated, the distance between neighboring fins is maintained, and condensate water is efficiently discharged.

19 Claims, 8 Drawing Sheets

(56) References Cited

FOREIGN PATENT DOCUMENTS

| | | | | |
|---|---|---|---|---|
| JP | 2004020174 | A | | 1/2004 |
| JP | 2004036938 | A | | 2/2004 |
| JP | 2005090939 | A | | 4/2005 |
| JP | 2006258383 | A | | 9/2006 |
| JP | 2008045765 | A | | 2/2008 |
| JP | 2010255885 | A | * | 11/2010 |
| JP | 2011-007409 | A | | 1/2011 |
| KR | 10-2000-0001652 | A | | 1/2000 |
| KR | 1020000001652 | A | | 1/2000 |
| WO | 2007-004456 | A1 | | 1/2007 |
| WO | 2011-033767 | A1 | | 3/2011 |

* cited by examiner

HEAT EXCHANGER

CROSS-REFERENCE TO RELATED APPLICATIONS

The present application claims the benefit of priority under 35 U.S.C. 119 to Korean Patent Application No. 10-2011-0037412 (filed on Apr. 21, 2011) which is hereby incorporated by reference in its entirety.

BACKGROUND

The present disclosure relates to a heat exchanger.

Heat exchangers exchange heat between refrigerant flowing therein and indoor or outdoor air. Such a heat exchanger includes a tube and a plurality of fins for increasing a heat exchange area between air and refrigerant flowing through the tube.

Heat exchangers are classified into fin-and-tube type ones and micro-channel type ones, according to their shapes. A fin-and-tube type heat exchanger includes a plurality of fins and a tube passing through the fins. A micro-channel type heat exchanger a plurality of flat tubes and a fin bent at several times within between the flat tubes. Both the fin-and-tube type heat exchanger and the micro-channel type heat exchanger exchange heat between an outer fluid and refrigerant flowing within the tube or the flat tube, and the fins increase a heat exchange area between the outer fluid and the refrigerant flowing within the tube or the flat tube.

However, such heat exchangers have the following limitations.

First, the tube of a fin-and-tube type heat exchanger passes through the fins. Thus, even when condensate water generated while the fin-and-tube type heat exchanger operates as an evaporator flows down along the fins, or is frozen onto the outer surface of the tube or the fins, the heat exchanger can efficiently remove the condensate water. However, since fin-and-tube type heat exchangers include only a single refrigerant passage in the tube, heat exchange efficiency of the refrigerant is substantially low.

On the contrary, since a micro-channel type heat exchanger includes a plurality of refrigerant passages within the flat tube, the micro-channel type heat exchanger is higher in heat exchange efficiency of the refrigerant than a fin-and-tube type heat exchanger. However, micro-channel type heat exchangers include the fin between the flat tubes. Thus, condensate water generated while a micro-channel type heat exchanger operates as an evaporator may be substantially frozen between the flat tubes. In addition, the frozen water may substantially degrade the heat exchange efficiency of the refrigerant.

SUMMARY

Embodiments provide a heat exchanger having high heat exchange efficiency.

Embodiments also provide a heat exchanger for more simply improve heat exchange efficiency.

In one embodiment, a heat exchanger includes: a plurality of tubes accommodating respective refrigerant passages through which refrigerant flows; and a plurality of fins having a plate shape, spaced apart from each other, and including: a plurality of through holes through which the tubes pass, respectively, wherein the fin is provided with a condensate water guide part guiding discharge of condensate water generated during heat exchange between air and the refrigerant flowing through the tube.

In another embodiment, a heat exchanger includes: a plurality of tubes accommodating respective refrigerant passages through which refrigerant flows; and a plurality of fins having a plate shape, spaced apart from each other, and including a plurality of through holes through which the tubes pass, respectively, each of the fins including a first slope, a second slope, and a plurality of louvers, wherein the first slope is provided in two, which are inclined upward in a width direction of the fin from a surface of the fin, at both side ends of the fin; the second slope is provided in two, which are inclined downward in the width direction of the fin, at respective ends of the first slopes, and having respective ends connected to each other; and the louvers are provided on the second slopes.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
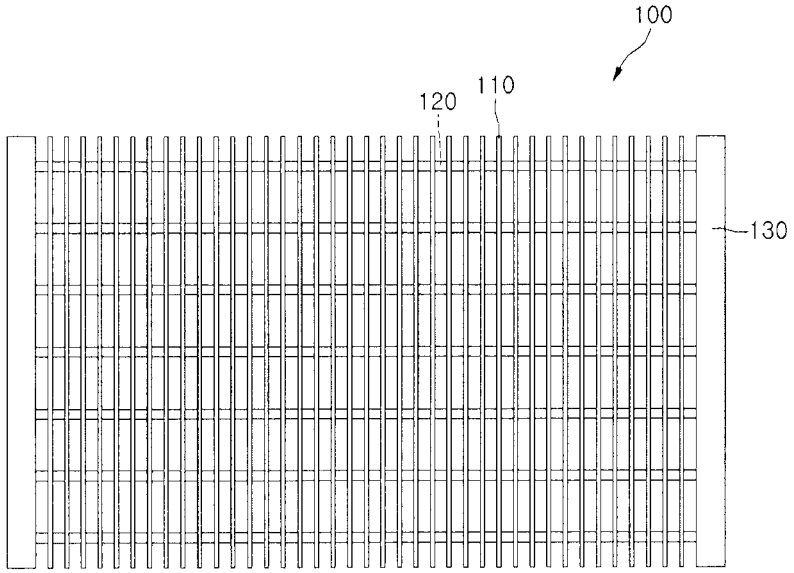
FIG. 1 is a front view illustrating a heat exchanger according to a first embodiment.
Figure 2:
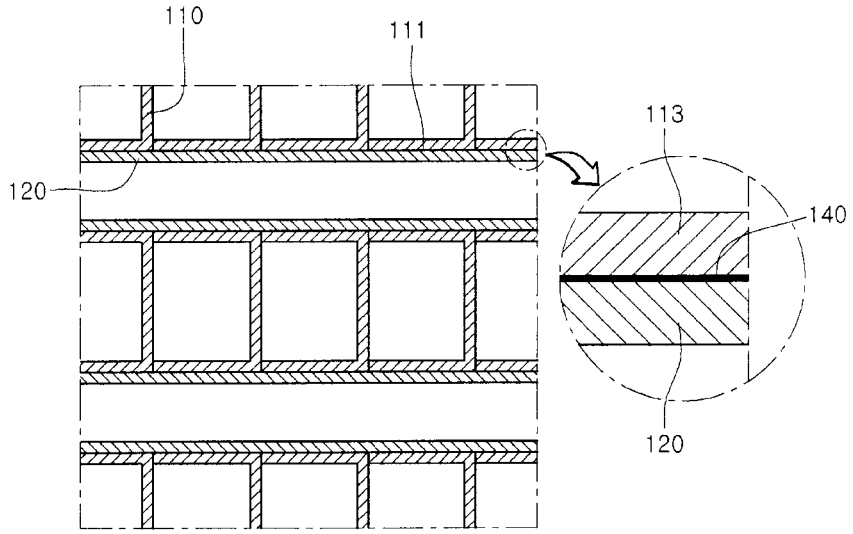
FIG. 2 is a cross-sectional view illustrating a principal part of the heat exchanger of FIG. 1.

FIG. 1 is a front view illustrating a heat exchanger according to a first embodiment. FIG. 2 is a cross-sectional view illustrating a principal part of the heat exchanger of FIG. 1.

Referring to FIGS. 1 and 2, a heat exchanger 100 according to the current embodiment includes: a plurality of fins 110 having a plate shape; a plurality of tubes 120 passing through the fins 110; and a plurality of headers 130 disposed at both sides of the tubes 120 to connect corresponding ends of the tubes 120 to one another. That is, the fins 110 are not disposed between the tubes 120, and the tubes 120 pass through the fins 110.

In more detail, the fins 110 have a rectangular plate shape with a predetermined length. The fins 110 substantially increase a heat exchange area between an external fluid and refrigerant flowing through the tubes 120. The fins 110 are spaced a predetermined distance from one another such that each of both side surfaces of the fins 110 faces a side surface of a neighboring one of the fins 110.

To this end, each of the fins 110 has through holes 111. The tubes 120 pass through the through holes 111. The through holes 111 are spaced apart from one another in the longitudinal direction of the fins 110 by a predetermined distance, substantially by a distance between the tubes 120.

Each of the fins 110 is provided with ribs 113. The ribs 113 are disposed at a side of the fins 110 to correspond to the periphery of the through holes 111. Thus, substantially, the ribs 113 may have a tube shaped inner surface corresponding to the outer surface of the tubes 120.

In more detail, the ribs 113 are perpendicular to a surface of the fins 110. The ribs 113 tightly contact the outer surface of the tubes 120 passing through the fins 110. That is, the ribs 113 may substantially increase an adhering area between the fin 110 and the tube 120.

The ribs 113 have a length corresponding to a distance between neighboring ones of the fins 110. When the tube 120 passes through the fins 110, the front end of the rib 113 provided to one of neighboring ones of the fins 110 contacts a surface of the other one. Thus, the rib 113 substantially maintains the distance between the neighboring fins 110.

For example, the tubes 120 may be longitudinally elongated through extrusion molding. The tubes 120 pass through the fins 110 such that the tubes 120 are spaced a predetermined distance from one another in the longitudinal direction of the fins 110. The tubes 120 may be hollow bodies having a predetermined length along a straight line. Refrigerant passages (not shown) through which the refrigerant flows are disposed within the tubes 120.

The fins 110 are coupled and fixed to the tubes 120 through brazing. Referring to FIG. 2, a sheet-shaped brazing material 140 is placed on the outer surfaces of the tubes 120, and then, the fins 110 are coupled to the tubes 120. At this point, the brazing material 140 is substantially disposed between the outer surface of the tubes 120 and the inner surface of the ribs 113. Then, the fins 110, the tubes 120, and the brazing material 140 are heated to a predetermined temperature. Accordingly, the brazing material 140 is melted to fix the fins 110 and the tubes 120.

The headers 130 are connected to both the ends of the tubes 120, respectively. The headers 130 distribute the refrigerant to the tubes 120. To this end, baffles (not shown) are disposed within the headers 130.

Hereinafter, a method of manufacturing a heat exchanger will now be described according to the first embodiment.

First, the tubes 120 are coupled to the fins 110 provided in a stacked structure. The tubes 120 with the brazing material 140 on the outer surfaces thereof sequentially pass through the through holes 111 of the fins 110. Thus, when the tubes 120 pass through the fins 110, the outer surfaces of the tubes 120 substantially approach the inner surfaces of the ribs 113.

When the fins 110 are stacked, the front end of the ribs 113 of the fins 110 tightly contacts a surface of adjacent ones of the fins 110. Thus, neighboring ones of the fins 110 are spaced apart from each other by the distance corresponding to the length of the ribs 113.

The brazing material 140 is disposed between each of the tubes 120 and the fins 110. For example, when the brazing material 140 is attached in the form of sheet to the outer surfaces of the tubes 120, the fins 110 may be coupled to the tubes 120. Thus, the brazing material 140 may be substantially disposed between the outer surface of the tubes 120 and the inner surface of the ribs 113.

Next, the fins 110 and the tubes 120 are fixed through brazing. For example, when the fins 110 and the tubes 120 are heated to a predetermined temperature, for example, to a temperature ranging from about 500° C. to about 700° C., the brazing material 140 are melted to fix the fins 110 and the tubes 120.

Meanwhile, as described above, the brazing material 140 is disposed between the outer surface of the tubes 120 and the inner surface of the ribs 113. Thus, the area of the inner surface of the ribs 113 is substantially equal to the adhering area between the tube 120 and the fin 110. That is, the ribs 113 increase the adhering area between the tube 120 and the fin 110, thereby increasing adhering strength between the tube 120 and the fin 110. In addition, the ribs 113 substantially maintain the distance between the neighboring fins 110.

Hereinafter, a heat exchanger according to a second embodiment will now be described with reference to the accompanying drawing.

Figure 3:
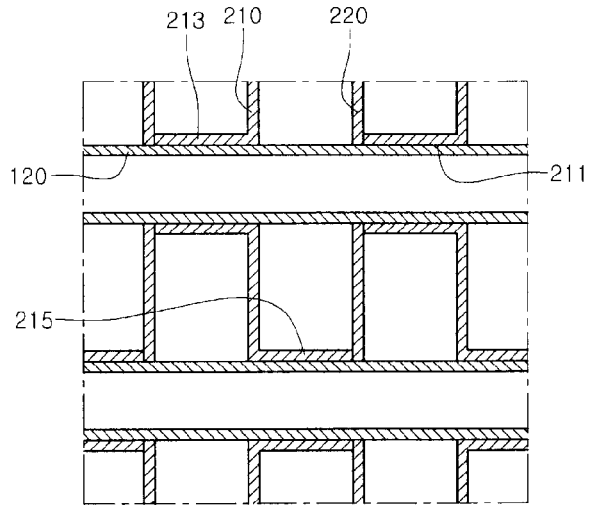
FIG. 3 is a cross-sectional view illustrating a principal part of a heat exchanger according to a second embodiment.

FIG. 3 is a cross-sectional view illustrating a principal part of a heat exchanger according to the second embodiment. Like reference numerals denote like elements in the first and second embodiments, and a description of the same components as those of the first embodiment will be omitted in the second embodiment.

Referring to FIG. 3, first fins 210 and second fins 220 are provided according to the current embodiment. The first and second fins 210 and 220 are provided with through holes 211 through which tubes 120 pass. First and second ribs 213 and 215 are provided only to the first fins 210. That is, the second fins 220 have a plate shape, like fins applied to a related art heat exchanger.

The first and second ribs 213 and 215 extend in different directions. That is, the first ribs 213 extend to the left side of FIG. 3 from the left surfaces of the first fins 210, and the second ribs 215 extend to the right side of FIG. 3 from the right surfaces of the first fins 210. A plurality of the first ribs 213 and a plurality of second ribs 215 are alternately disposed at the peripheries of the through holes 211 that are vertically spaced apart from one another in the first fins 210. That is, when the first rib 213 is disposed at the periphery of the through hole 211 disposed at the upper end of the first fins 210, the second rib 215 is disposed at the periphery of the through hole 211 disposed under the first rib 213. In a same manner, a plurality of the first fins 210 and a plurality of the second fins 220 are alternately disposed in the longitudinal direction of the tubes 120. In this case, the second fins 220 may be disposed in positions closest to headers 230.

Hereinafter, a heat exchanger according to third and fourth embodiments will now be described with reference to the accompanying drawings.

Figure 4:
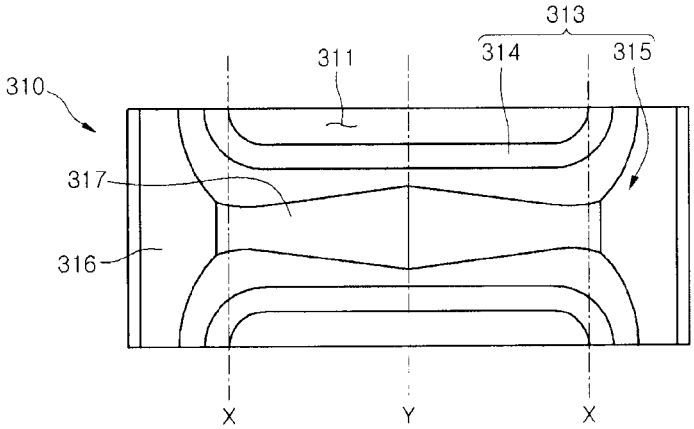
FIG. 4 is a front view illustrating a principal part of a fin constituting a heat exchanger according to a third embodiment.
Figure 5:
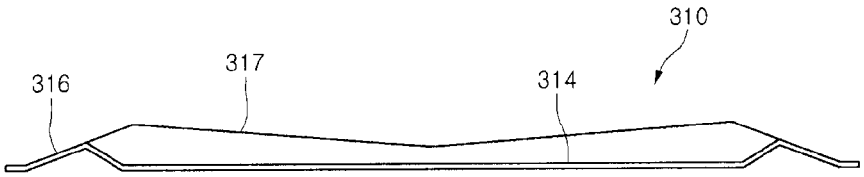
FIG. 5 is a cross-sectional view illustrating a fin according to the third embodiment.
Figure 6:
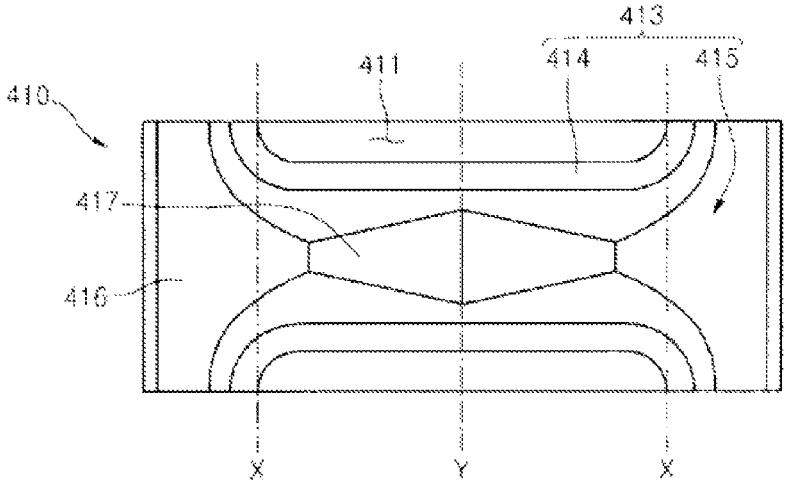
FIG. 6 is a front view illustrating a principal part of a fin constituting a heat exchanger according to a fourth embodiment.
Figure 7:
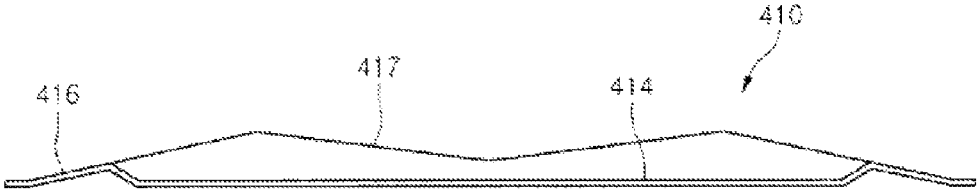
FIG. 7 is a cross-sectional view illustrating a fin according to the fourth embodiment.
Figure 8:
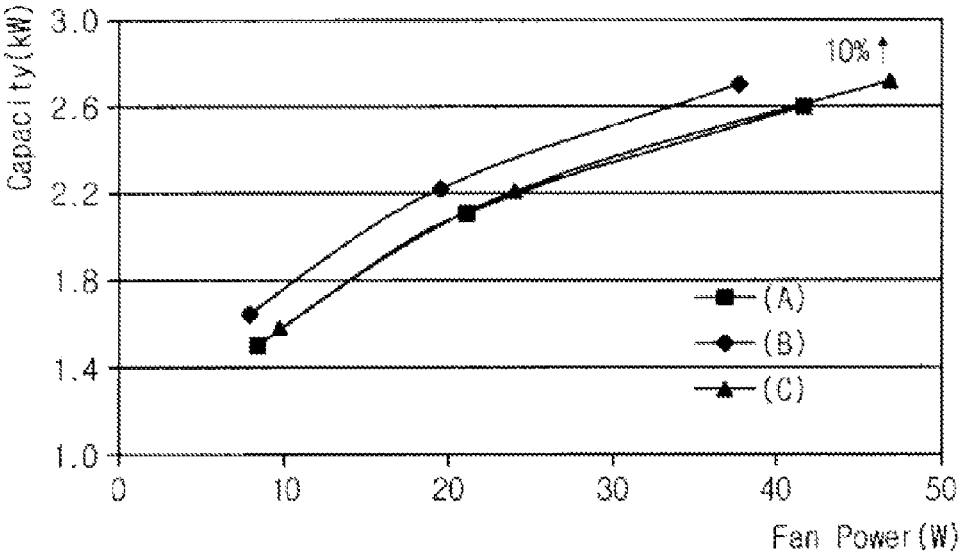
FIG. 8 is a graph illustrating fan power and heat transfer capacity of a heat exchanger according to fin shapes in accordance with the third and fourth embodiments.

FIG. 4 is a front view illustrating a principal part of a fin constituting a heat exchanger according to the third embodiment. FIG. 5 is a cross-sectional view illustrating a fin according to the third embodiment. FIG. 6 is a front view illustrating a principal part of a fin constituting a heat exchanger according to the fourth embodiment. FIG. 7 is a cross-sectional view illustrating a fin according to the fourth embodiment. FIG. 8 is a graph illustrating fan power and heat transfer capacity of a heat exchanger according to fin shapes in accordance with the third and fourth embodiments.

Referring to FIGS. 4 and 5, an outer surface of a fin 310 according to the third embodiment is provided with a condensate water discharge part 313 for discharging condensate water. The condensate water discharge part 313 is formed substantially by recessing and projecting a portion of the fin 310 corresponding to a space between neighboring through holes 311. In more detail, the condensate water discharge part 313 includes a first guide part 314 and a second guide part 315. The first guide part 314 and the second guide part 315 are formed substantially as a single body.

The first guide part 314 is inclined upward to the outside of the through hole 311 from a portion of the fin 310 adjacent to the periphery of the through hole 311. The outer edge of the first guide part 314 is connected to the second guide part 315.

The second guide part 315 includes two first slopes 316 and two second slopes 317. The first slopes 316 extend in the width direction of the fin 310, at the lateral ends of the fin 310. Each of the second slopes 317 extends in the width direction of the fin 310, at the end of the first slope 316 corresponding to the space between the through holes 311.

The first slopes 316 are inclined upward from a surface of the fin 310 at the lateral ends of the fin 310. Each of the second slopes 317 is inclined downward from a surface of the fin 310, at an end of the first slope 316. Thus, substantially, a portion where ends of the first slopes 316 meet ends of the second slopes 317 constitutes a ridge, and a portion where ends of the second slopes 317 are connected to each other constitutes a valley, thereby forming an uneven structure.

An end of the first slopes 316 is connected to an end of the second slopes 317 in a region between one of both side ends of the fin 310 and one of imaginary lines (hereinafter, referred to as first lines X) passing through both the side ends of the through holes 311 in the longitudinal direction of the fin 310. Ends of the second slopes 317 are connected to each other on an imaginary line (hereinafter, referred to as a second line Y) passing through the center of the width of the through holes 311 in the longitudinal direction of the fin 310. The second slopes 317 are substantially longer than the first slopes 316 in the width direction of the fin 310.

Accordingly, condensate water, which is generated at a side of the tube 120 and the fin 310 adjacent to the tube 120 while a heat exchanger 300 is operated, is substantially guided along the first guide part 314 and the second guide part 315. The condensate water substantially flows downward along both the side ends of the fin 310, that is, along the first slopes 316. Thus, condensate water is efficiently discharged from a surface of the fin 310 to prevent freezing, thereby substantially improving heat exchange efficiency of the heat exchanger 300.

Referring to FIGS. 6 and 7, according to the fourth embodiment, first and second slopes 416 and 417 constituting a second guide part 415 have the same length in the width direction of a fin 410 To this end, ends of the first and second slopes 416 and 417 are connected to each other in the region between the first line X and the second line Y. Thus, substantially, the length of the first slopes 416 in the width direction of the fin 410 is further increased, and the length of the second slopes 417 is further decreased than those of the first embodiment.

Referring to FIG. 8, effects according to the third and fourth embodiments can be predicted. In detail, an X axis and a Y axis of FIG. 8 denote fan power (W) and heat transfer capacity (kW) of a heat exchanger, respectively. Line A of FIG. 8 corresponds to a heat exchanger including a fin in which an end of a first slope is connected to an end of a second slope on the first line X. Line B and line C of FIG. 8 correspond to heat exchangers including fins according to the third and fourth embodiments, respectively. In these cases, the other conditions except for the shapes of the fins, that is, the conditions of tubes and fans are the same. As illustrated in FIG. 8, when fan power is fixed, the heat exchangers according to the third and fourth embodiments is higher in heat transfer efficiency than the heat exchanger including the fin in which the ends of the first and second slopes are connected on the first line X. Moreover, the heat exchanger according to the third embodiment is higher in heat transfer efficiency than the heat exchanger according to the fourth embodiment at the same fan power.

Hereinafter, a heat exchanger according to fifth and sixth embodiments will now be described with reference to the accompanying drawings.

Figure 9:
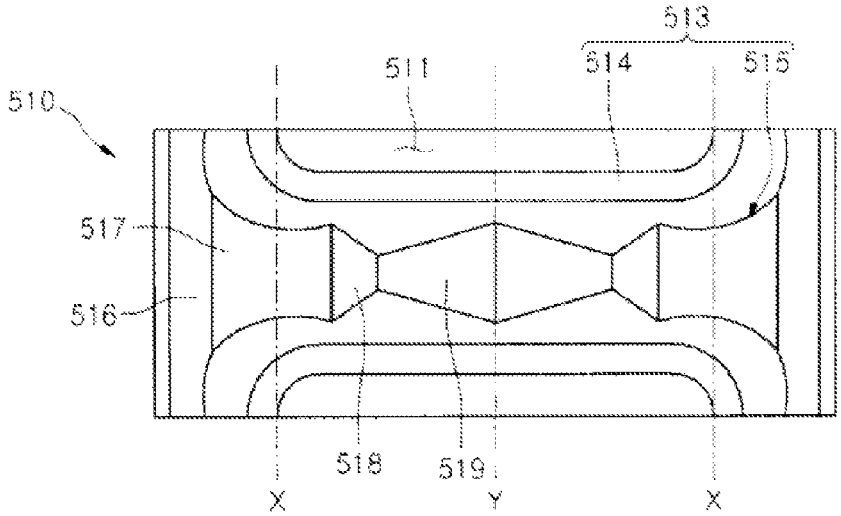
FIG. 9 is a front view illustrating a principal part of a fin constituting a heat exchanger according to a fifth embodiment.
Figure 10:
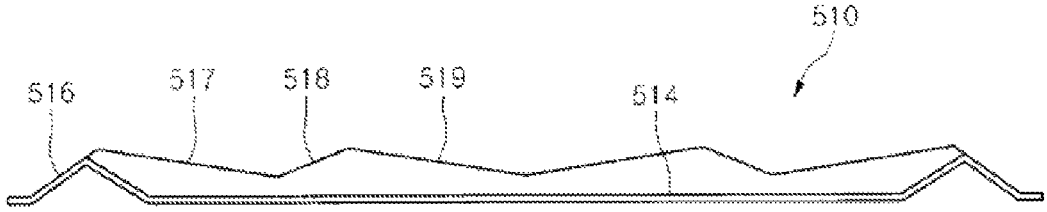
FIG. 10 is a cross-sectional view illustrating a fin according to the fifth embodiment.
Figure 11:
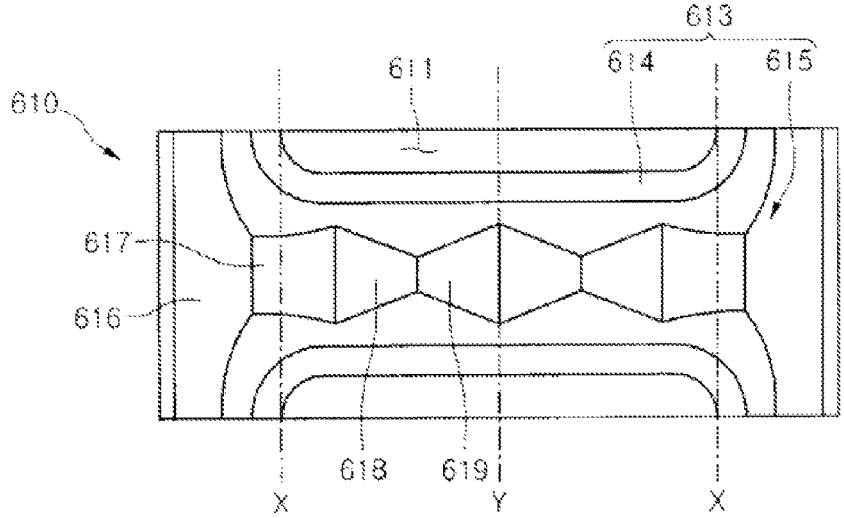
FIG. 11 is a front view illustrating a principal part of a fin constituting a heat exchanger according to a sixth embodiment.
Figure 12:
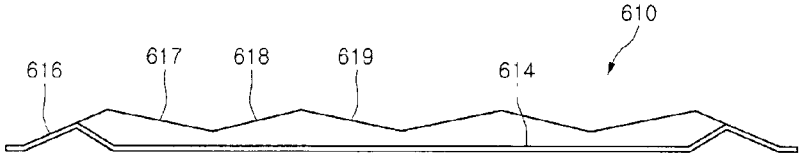
FIG. 12 is a cross-sectional view illustrating a fin according to the sixth embodiment.

FIG. 9 is a front view illustrating a principal part of a fin constituting a heat exchanger according to the fifth embodiment. FIG. 10 is a cross-sectional view illustrating a fin according to the fifth embodiment. FIG. 11 is a front view illustrating a principal part of a fin constituting a heat exchanger according to the sixth embodiment. FIG. 12 is a cross-sectional view illustrating a fin according to the sixth embodiment. Like reference numerals denote like elements in the third to sixth embodiments, and a description of the same components as those of the third and fourth embodiments will be omitted in the fifth and sixth embodiments.

Referring to FIGS. 9 and 10, a second guide part 515 according to the fifth embodiment includes first to fourth slopes 516, 517, 518, and 519. The first slopes 516 are inclined upward in the width direction of the fin 510 at the lateral ends of a fin 510. Each of the second slopes 517 is inclined downward in the width direction of the fin 510, at an end of the first slope 516. Each of the third slopes 518 is inclined upward in the width direction of the fin 510, at an end of the second slope 517. Each of the fourth slopes 519 is inclined downward in the width direction of the fin 510, at an end of the third slope 518.

Ends of the first and second slopes 516 and 517 are connected to each other between the first line X and one of both side ends of the fin 510. Ends of the second and third slopes 517 and 518 are connected to each other between the first line X and the second line Y. Also, ends of the third and fourth slopes 518 and 519 are connected to each other between the first line X and the second line Y. In this case, the ends of the second and third slopes 517 and 518 are closer to the first line X, and the ends of the third and fourth slopes 518 and 519 are closer to the second line Y. Ends of the fourth slopes 519 are connected to each other on the second light Y. The second slopes 517 are longer than the first slopes 516 in the width direction of the fin 510. The fourth slopes 519 are longer than the third slopes 518 in the width direction of the fin 510.

Referring to FIGS. 11 and 12, the sixth embodiment is the same as the fifth embodiment in that a second guide part 615 according to the sixth embodiment includes first to fourth slopes 616, 617, 618, and 619 that are inclined upward or downward in turn. However, the first to fourth slopes 616, 617, 618, and 619 have the same length in the width direction of a fin 610.

In addition, according to the length of the first and second slopes 616 and 617 in the width direction of the fin 610, relative positions of a connected portion of the first and second slopes 616 and 617, a connected portion of the second and third slopes 617 and 618, and a connected portion of the third and fourth slopes 618 and 619, to the first and second lines X and Y are different from that of the fifth embodiment. In more detail, ends of the first and second slopes 616 and 617 are connected to each other between the first line X and one of both side ends of the fin 610. Ends of the second and third slopes 617 and 618 are connected to each other between the first line X and the second line Y. Also, ends of the third and fourth slopes 618 and 619 are connected to each other between the first line X and the second line Y. In this case, the ends of the second and third slopes 617 and 618 are closer to the first line X, and the ends of the third and fourth slopes 618 and 619 are closer to the second line Y. Ends of the fourth slopes 619 are connected to each other on the second light Y.

Hereinafter, a heat exchanger according to a seventh embodiment will now be described with reference to the accompanying drawings.

Figure 13:
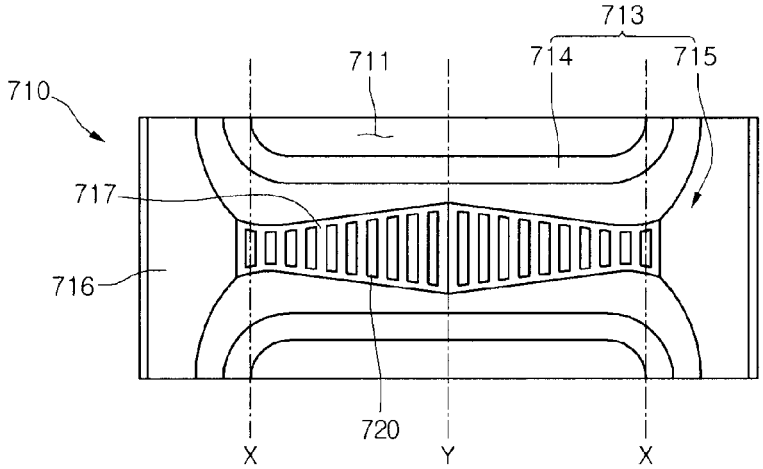
FIG. 13 is a front view illustrating a principal part of a fin constituting a heat exchanger according to a seventh embodiment.
Figure 14:
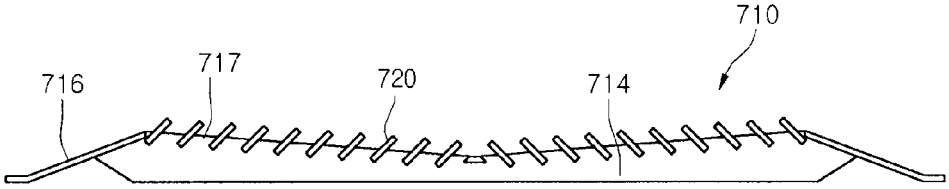
FIG. 14 is a cross-sectional view illustrating a fin according to the seventh embodiment.
Figure 15:
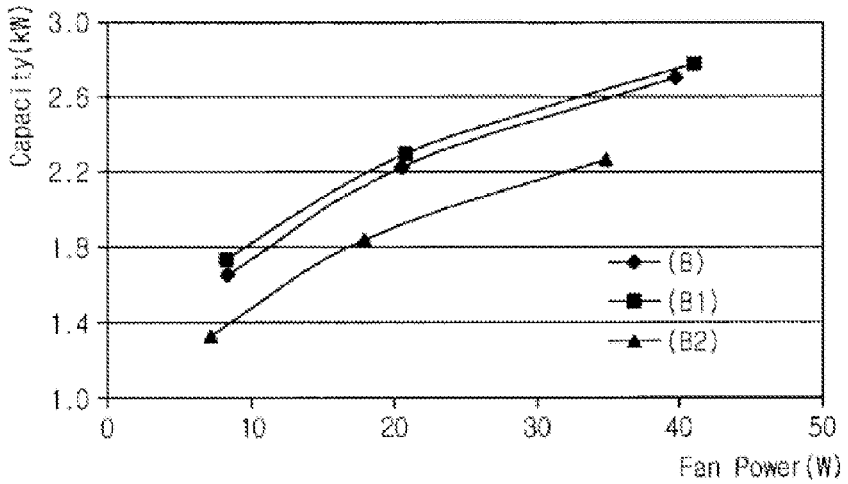
FIG. 15 is a graph illustrating fan power and heat transfer capacity of a heat exchanger according to the presence and position of louvers in accordance with the seventh embodiment.

FIG. 13 is a front view illustrating a principal part of a fin constituting a heat exchanger according to the seventh embodiment. FIG. 14 is a cross-sectional view illustrating a fin according to the seventh embodiment. FIG. 15 is a graph illustrating fan power and heat transfer capacity of a heat exchanger according to the presence and position of louvers in accordance with the seventh embodiment.

Referring to FIGS. 13 and 14, a fin 710 according to the current embodiment is provided with a through hole 711 through which a tube (not shown) passes, and a condensate water discharge part 713 for discharging condensate water. The condensate water discharge part 713 includes a first guide part 714 and a second guide part 715. The second guide part 715 includes two first slopes 716 and two second slopes 717.

The above configuration of the fin 710, that is, the through hole 711 and the condensate water discharge part 713 are the same as those of the third embodiment. Particularly, the seventh embodiment is the same as the third embodiment in that: the condensate water discharge part 713 includes the first guide part 714 and the second guide part 715; and the second guide part 715 includes the first slopes 716 and the second slopes 717.

The fin 710 is provided with a plurality of louvers 720. The louvers 720 may be formed by cutting portions of the fin 710, substantially, by cutting portions of the condensate water discharge part 713 in the width direction of the fin 710, and then, by bending the cut portions from the rest of the fin 710. In the current embodiment, the louvers 720 are disposed only on the second slopes 717.

Referring to FIG. 15, effects according to the seventh embodiment can be predicted. In more detail, an X axis and a Y axis of FIG. 15 denote fan power (W) and heat transfer capacity (kW) of a heat exchanger, respectively. Line B of FIG. 15 corresponds to a heat exchanger including the fin 310 according to the third embodiment, that is, a heat exchanger including a fin without a louver. Line B1 of FIG. 15 corresponds to a heat exchanger including the fin 710 according to the seventh embodiment, that is, a heat exchanger including the fin 710 having the louvers 720 only on the second slopes 717. Line B2 of FIG. 15 corresponds to a heat exchanger including louvers disposed entirely on the second guide part 315 of the fin 310, that is, a heat exchanger including the fin 310 having louvers on both the first and second slopes 316 and 317. As illustrated in FIG. 15, when fan power is fixed, the heat exchanger according to the seventh embodiment is higher in heat transfer efficiency than the heat exchanger according to the third embodiment. However, the heat exchanger including louvers disposed on both the first and second slopes 316 and 317 is lower in heat transfer efficiency than the heat exchanger including the fin without a louver according to the third embodiment. This is because an increase of pressure loss due to louvers is greater than an increase of heat transfer efficiency due to the louvers. As a result, the heat transfer efficiency of the heat exchanger including louvers disposed on both the first and second slopes 316 and 317 is substantially decreased at the same fan output.

Hereinafter, a heat exchanger according to eighth to tenth embodiments will now be described with reference to the accompanying drawings.

Figure 16:
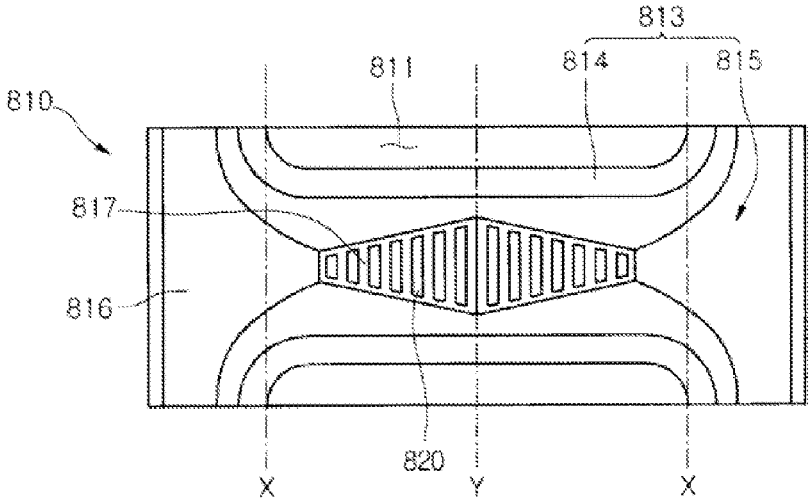
FIG. 16 is a front view illustrating a principal part of a fin constituting a heat exchanger according to an eighth embodiment.
Figure 17:
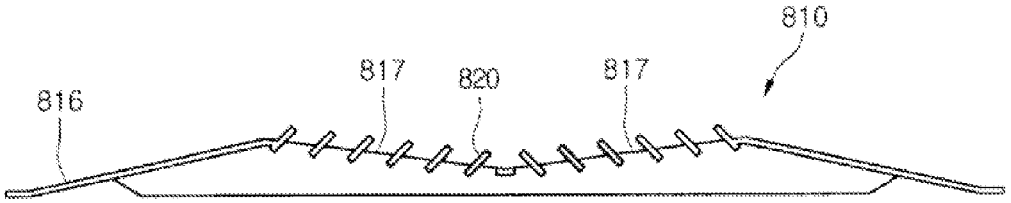
FIG. 17 is a cross-sectional view illustrating a fin according to the eighth embodiment.
Figure 18:
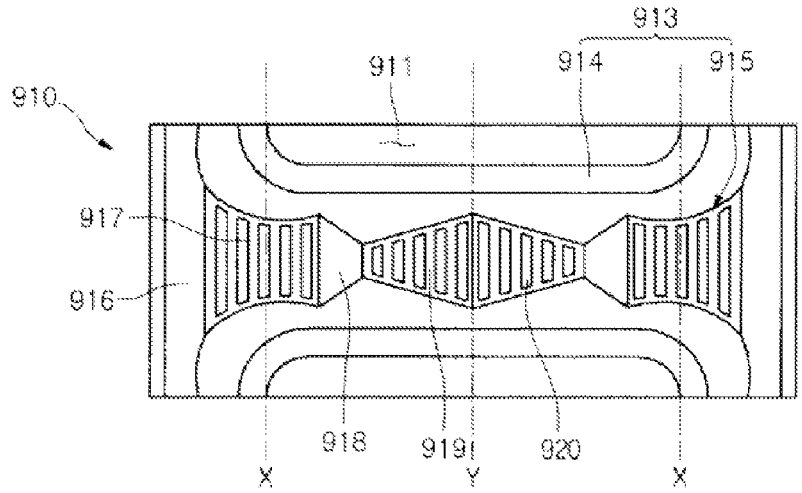
FIG. 18 is a front view illustrating a principal part of a fin constituting a heat exchanger according to a ninth embodiment.
Figure 19:
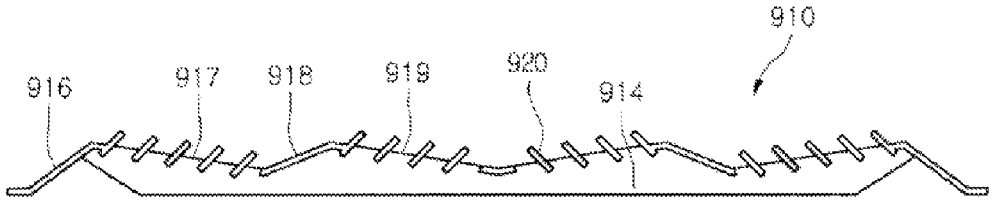
FIG. 19 is a cross-sectional view illustrating a fin according to the ninth embodiment.
Figure 20:
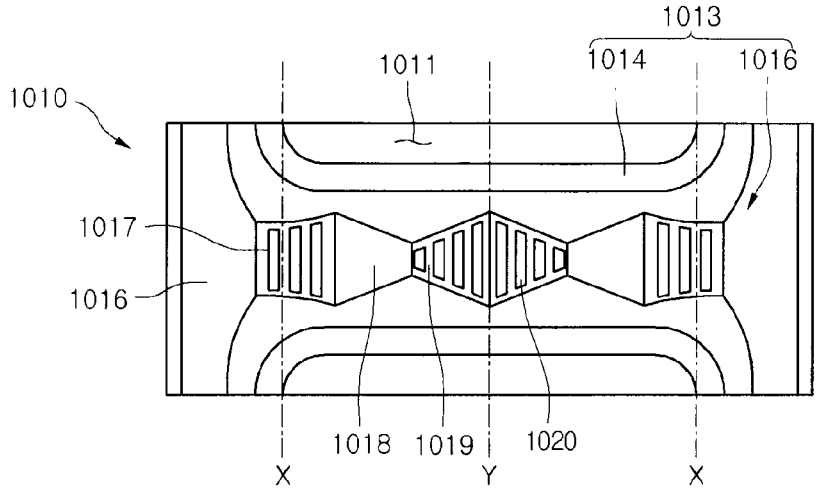
FIG. 20 is a front view illustrating a principal part of a fin constituting a heat exchanger according to a tenth embodiment.
Figure 21:
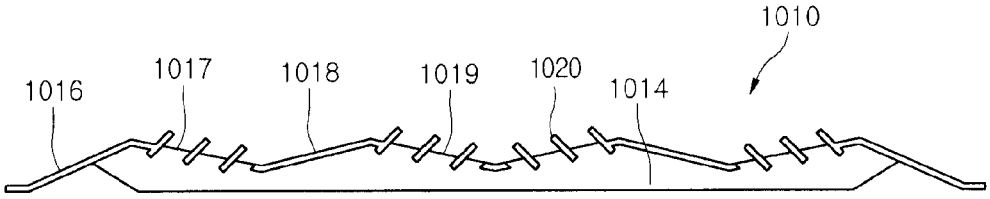
FIG. 21 is a cross-sectional view illustrating a fin according to the tenth embodiment.

FIG. 16 is a front view illustrating a principal part of a fin constituting a heat exchanger according to the eighth embodiment. FIG. 17 is a cross-sectional view illustrating a fin according to the eighth embodiment. FIG. 18 is a front view illustrating a principal part of a fin constituting a heat exchanger according to the ninth embodiment. FIG. 19 is a cross-sectional view illustrating a fin according to the ninth embodiment. FIG. 20 is a front view illustrating a principal part of a fin constituting a heat exchanger according to the tenth embodiment. FIG. 21 is a cross-sectional view illustrating a fin according to the tenth embodiment.

Referring to FIGS. 16 and 17, a fin 810 according to the eighth embodiment is provided with a plurality of louvers 820. The rest of the fin 810 except for the louvers 820 may have the same configuration as that of the fourth embodiment. For example, the louvers 820 may be provided to a second guide part 815, that is, second slopes 817 as illustrated in FIGS. 16 and 17.

Referring to FIGS. 18 and 19, a fin 910 according to the ninth embodiment has the same configuration as that of the fifth embodiment except for louvers 920. Referring to FIGS. 20 and 21, a fin 1010 according to the tenth embodiment has the same configuration as that of the sixth embodiment except for louvers 1020. That is, the ninth and tenth embodiments may be suggested by adding the louvers 920 and 1020 to the fifth and sixth embodiments. According to the ninth embodiment, a second guide part 915 includes first to fourth slopes 916, 917, 918, and 919, and the louvers 920 may be provided to the second guide part 915, substantially, to only the second and fourth slopes 917 and 919. In a same manner, according to the tenth embodiment, a second guide part 1015 includes first to fourth slopes 1016, 1017, 1018, and 1019, and the louvers 1020 may be provided to the second guide part 1017, substantially, to only the second and fourth slopes 1017 and 1019.

According to the above embodiments, the second line passing through the center of the through hole is used to describe the position of each slope constituting the condensate water discharge part. Thus, when the center of the width of the through hole is aligned with the center of the width of the fin, the second line passes through the center of the width of the fin.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger comprising:

a plurality of tubes accommodating respective refrigerant passages through which refrigerant flows; and a plurality of fins having a plate shape, spaced apart from each other, and including: a plurality of through holes through which the tubes pass, respectively, wherein the fin is provided with a condensate water guide part guiding discharge of condensate water generated during heat exchange between air and the refrigerant flowing through the tube, wherein at least one portion of the fin is provided with ribs to increase an adhering area between the fin and the tube.

2. The heat exchanger according to claim 1, wherein the condensate water guide part comprises slopes formed by inclining a portion of the fin upward and downward from a surface of the fin.

3. The heat exchanger according to claim 1, wherein the condensate water guide part comprises:

two first slopes inclined upward in a width direction of the fin from a surface of the fin, at both side ends of the fin; and two second slopes inclined downward in the width direction of the fin, at respective ends of the first slopes, and having respective ends connected to each other.

4. The heat exchanger according to claim 3, wherein the second slope is provided with a plurality of louvers.

5. The heat exchanger according to claim 3, wherein each of the first slopes is connected to a corresponding one of the second slopes between a corresponding one of both the side ends of the fin and a corresponding one of imaginary lines extending in a longitudinal direction of the fin to pass through both ends of the through hole, and the second slopes are connected to each other on an imaginary line extending in the longitudinal direction of the fin to pass through a central portion of the through hole.

6. The heat exchanger according to claim 3, wherein each of the first slopes is connected to a corresponding one of the second slopes between a corresponding one of imaginary lines extending in a longitudinal direction of the fin to pass through both ends of the through hole, and an imaginary line extending in the longitudinal direction of the fin to pass through a central portion of a width of the through hole, and the second slopes are connected to each other on the imaginary line extending in the longitudinal direction of the fin to pass through the central portion of the width of the through hole.

7. The heat exchanger according to claim 3, wherein a length of the second slope in the width direction of the fin is equal to or greater than a length of the first slope in the width direction of the fin.

8. The heat exchanger according to claim 1, wherein the condensate water guide part comprises:

two first slopes inclined upward in a width direction of the fin from a surface of the fin, at both side ends of the fin a plurality of second slopes each inclined downward in the width direction of the fin, at an end of the first slope;

a plurality of third slopes each inclined upward in the width direction of the fin, at an end of the second slope; and a plurality of fourth slopes each inclined downward in the width direction of the fin, at an end of the third slope, and having respective ends connected to each other.

9. The heat exchanger according to claim 8, wherein the second and fourth slopes are provided with a plurality of louvers.

10. The heat exchanger according to claim 8, wherein the first slopes are connected to the second slopes on imaginary lines extending in a longitudinal direction of the fin to pass through both ends of the through hole, each of the second slopes and each of the third slopes are connected to a corresponding one of the third slopes and a corresponding one of the fourth slopes, respectively, between a corresponding one of the imaginary lines extending in the longitudinal direction of the fin to pass through both the ends of the through hole, and an imaginary line extending in the longitudinal direction of the fin to pass through a central portion of a width of the through hole, and the fourth slopes are connected to each other on the imaginary line extending in the longitudinal direction of the fin to pass through the central portion.

11. The heat exchanger according to claim 8, wherein each of the first slopes, each of the second slopes, and each of the third slopes are connected to a corresponding one of the second slopes, a corresponding one of the third slopes, and a corresponding one of the fourth slopes, respectively, between a corresponding one of the imaginary lines extending in the longitudinal direction of the fin to pass through both the ends of the through hole, and the imaginary line extending in the longitudinal direction of the fin to pass through the central portion, and the fourth slopes are connected to each other on the imaginary line extending in the longitudinal direction of the fin to pass through the central portion.

12. The heat exchanger according to claim 8, wherein a length of the second slope in the width direction of the fin is equal to or greater than a length of the first slope in the width direction of the fin, and a length of the fourth slope in the width direction of the fin is equal to or greater than a length of the third slope in the width direction of the fin.

13. The heat exchanger according to Claim 1, wherein the rib extends from a portion of the fin corresponding to a periphery of the through hole to contact a surface of another fin adjacent to the rib.

14. The heat exchanger according to claim 1, wherein a sheet-shaped brazing material is disposed between an outer surface of the tube and an inner surface of the rib to couple the fin and the tube through brazing.

15. A heat exchanger comprising:

a plurality of tubes accommodating respective refrigerant passages through which refrigerant flows; and a plurality of fins having a plate shape, spaced apart from each other, and including a plurality of through holes through which the tubes pass, respectively, each of the fins including a first slope, a second slope, and a plurality of louvers, wherein the first slope is provided in two, which are inclined upward in a width direction of the fin from a surface of the fin, at both side ends of the fin;

the second slope is provided in two, which are inclined downward in the width direction of the fin, at respective ends of the first slopes, and having respective ends connected to each other; and the louvers are provided on the second slopes.

16. The heat exchanger according to claim 15, wherein an end of each of the first slopes is connected to an end of a corresponding one of the second slopes between a corresponding one of both the side ends of the fin and a corresponding one of imaginary lines extending in a longitudinal direction of the fin to pass through both ends of the through hole, and the ends of the second slopes are connected to each other on an imaginary line extending in the longitudinal direction of the fin to pass through a central portion of the through hole.

17. The heat exchanger according to claim 15, wherein a length of the second slope in the width direction of the fin is greater than a length of the first slope in the width direction of the fin.

18. The heat exchanger according to claim 15, wherein at least one portion of the fin is provided with ribs that extend from a portion of the fin corresponding to a periphery of the through hole to increase an adhering area between the fin and the tube during brazing.

19. The heat exchanger according to claim 18, wherein a sheet-shaped brazing material is disposed between an outer surface of the tube and an inner surface of the rib to couple the fin and the tube through the brazing.

* * * * *